United States Patent [19]

Graham

[11] Patent Number: 4,629,145

[45] Date of Patent: Dec. 16, 1986

[54] CONTROL OF TRAVERSING GUIDE IN STRAND WINDING APPARATUS

[75] Inventor: Randall C. Graham, Nashville, Tenn.

[73] Assignee: Essex Group, Inc., Fort Wayne, Ind.

[21] Appl. No.: 845,740

[22] Filed: Mar. 28, 1986

[51] Int. Cl.[4] ..... B65H 54/28

[52] U.S. Cl. ..... 242/158 R; 242/25 R; 242/158.2

[58] Field of Search ..... 242/158 R, 158.2, 158.4 R, 242/158.4 A, 25 R

[56] References Cited

U.S. PATENT DOCUMENTS

| | | | |
|---|---|---|---|
| 3,413,834 | 12/1968 | Kovaleski | 72/289 |
| 3,829,037 | 8/1974 | Sallin | 242/158.2 |
| 3,876,166 | 4/1975 | Kadokura et al. | 242/158.2 |
| 4,485,978 | 12/1984 | O'Connor | 242/25 |

*Primary Examiner*—Stanley N. Gilreath
*Attorney, Agent, or Firm*—Robert D. Sommer

[57] ABSTRACT

Control means for the traversing guide drive means in apparatus for winding strand upon a rotating flanged spool comprising means adjustably positioned along the path of travel of the traversing guide for providing a reference position signal as the traversing guide passes in each direction through either of two reference positions near the respective end limits of its reciprocation, and means responsive to the reference position signals and including two bistable flip-flop circuits and a preset counter coupled to the spool rotating means for effecting a reversal in the direction of movement of the traversing guide when the count of spool revolutions occurring after the traversing guide passes a reference position while approaching one end limit of its travel attains a selected value, said last named means being reset for effecting a subsequent reversal operation at the other end limit in response to return movement of the traversing guide from the one end limit.

7 Claims, 4 Drawing Figures

FIG. 2
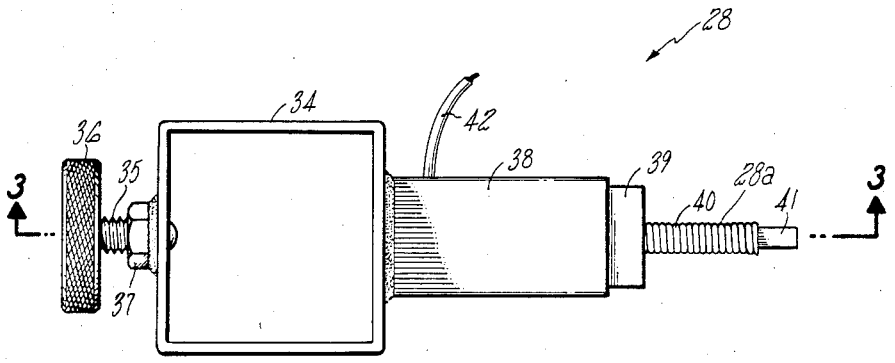
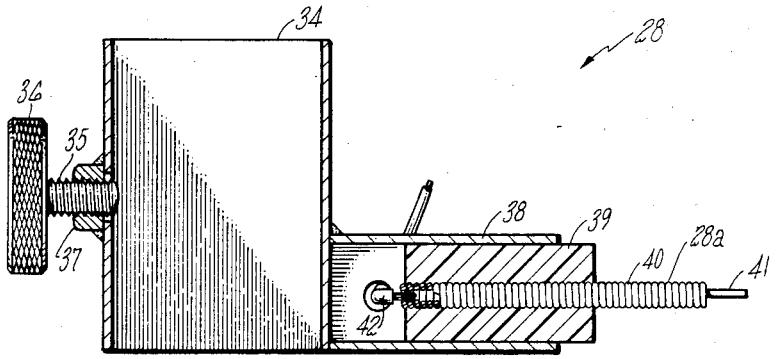
FIG. 3

CONTROL OF TRAVERSING GUIDE IN STRAND WINDING APPARATUS

BACKGROUND OF INVENTION

This invention relates to apparatus for winding strand onto flanged spools, and more particularly to improved means for controlling the drive of a traversing guide in such winding apparatus.

In the manufacture of electrical wire and other strand materials, the wire or strand material is commonly wound upon a flanged spool as it advances continuously from processing apparatus such as a drawing or coating machine. A typical wire winding apparatus includes means for supporting and rotating the spool and a traversing guide arranged to traverse the wire back and forth between the end flanges of the spool for winding the wire evenly onto the spool. Mechanical or electrical control means are employed to reverse the direction of traverse as the traversing guide approaches preset limit positions. U.S. Pat. No. 3,413,834, for example, discloses a reversible traversing drive controlled by adjustable trip members mounted on the traverse carriage and engageable with respective limit switches which are adjustably carried by a slide. With control means of this type, a time-consuming, precise readjustment of the trip members and limit switches is required for winding wire on spools of different lengths.

Other means for effecting a more precise control of the traversing guide movement in strand winding apparatus have been suggested in U.S. Pat. Nos. 3,829,037 and 3,876,166. The control means disclosed by each of these patents utilize an electronic control unit responsive to electric signal pulses generated when the traversing guide reaches one or more selected reference positions. The control means of the aforesaid two patents are not particularly suitable or adaptable to wire winding apparatus for winding wire on large flanged spools which may each accommodate from 100 to 450 kilograms of wire.

U.S. Pat. No. 4,485,978 also discloses a traversing guide control which employes a rather complicated electronic control unit to establish the end limits of reciprocation of a traversing guide in response to the generation of electric signal pulses at selected positions of the traversing guide. Although the winding apparatus of this patent is particularly suited for winding wire on large spools, considerable set-up time is required to effect manual adjustment of the reference position detector switches to accommodate different sizes of spools.

Thus, there is a need for an improved traversing guide control employing a simple electronic control system responsive to reference position signals which can be produced by reference position detectors that can be readily and precisely adjusted to selected positions along the path of travel of the traversing guide.

SUMMARY OF THE INVENTION

This invention provides improved control means for the drive means of a traversing guide used in apparatus for winding strand onto a rotating flanged spool. Such apparatus typically includes means for rotating the spool, a traversing guide for guiding strand onto the spool and reciprocating drive means responsive to alternate forward and reverse control signals to drive the traversing guide in respective forward and reverse directions between two adjustably selected reversal points or end limits. The present invention improves upon prior arrangements for control of the traversing guide drive means by employing solid state circuit elements in a unique arrangement responsive to signals from adjustably positioned reference position detector means which preferably include electrical contact members engageable by a contact element movable with the traversing guide.

The control means of the invention include reference position detector means operative to produce a reference position signal is response to movement of the traversing guide through selected reference positions, a first bistable flip-flop circuit having an output switched between a switched-on and a switched-off state by the reference position signals, a preset counter for counting spool revolutions and have an input connected to the output of the first bistable flip-flop circuit, a second bistable flip-flop circuit having an input connected to switch means of the counter, and means responsive to the output of the second bistable flip-flop circuit for producing forward and reverse control signals which are supplied by the drive means of the traversing guide. The reference position detector means are arranged to produce a first and then a second reference position signal as the traversing guide passes either of two selected reference positions during a respective approach to and consequent return from a reversal point. The output of the first bistable flip-flop circuit is switched from a switched-off state to a switched-on state in response to production of the first reference position signal and reverts to its switched-off state in response to production of the second reference position signal. The switching of the output of the first bistable flip-flop circuit to a switched-on state initiates counting operation by the preset counter to produce a count of spool revolutions and then allows actuation of the counter switch from a first operating state to a second operating state when the count attains a selected preset value. In response to switching of the output of the first bistable flip-flop circuit to a switched-off state, counting operation of the counter is inhibited, the counter count is reset to an initial value, and the counter switch is returned to its first operating state. Upon successive switching of the counter switch from its first operating state to its second operating state, the output of the second bistable flip-flop circuit is alternately switched from one to the other of its two operating conditions thereby causing the control signal producing means to alternately provide one and then other of said forward and reverse control signals.

The reference position detector means preferably comprise an electrical contact element movable with the traversing guide and two resilient contact members which are positioned at respective locations to be engaged by the contact element when the traversing guide passes a respective one of the reference positions in either direction and which are each deflectable out of engagement with the contact element upon continued movement of the traversing guide past the respective reference position. The contact element and the contact members are connected to the input means of impulse actuated on-off timer means in a circuit energized from a low voltage source and adapted to provide an input signal to the timer means when either of the contact members is engaged by the contact element. In response to each such input signal, the timer means produce an electrical signal pulse which is supplied as a reference position signal to the first bistable flip-flop circuit.

For a better understanding of the invention, reference may be had to the following detailed description taken in connection with the accompanying drawings, in which:

BRIEF DESCRIPTION OF THE DRAWINGS

FIG. 2 is an enlarged top view of a reference position detector shown in FIG. 1;

FIG. 3 is a sectional view taken along the line 3—3 of FIG. 2.

DETAILED DESCRIPTION

Figure 1:
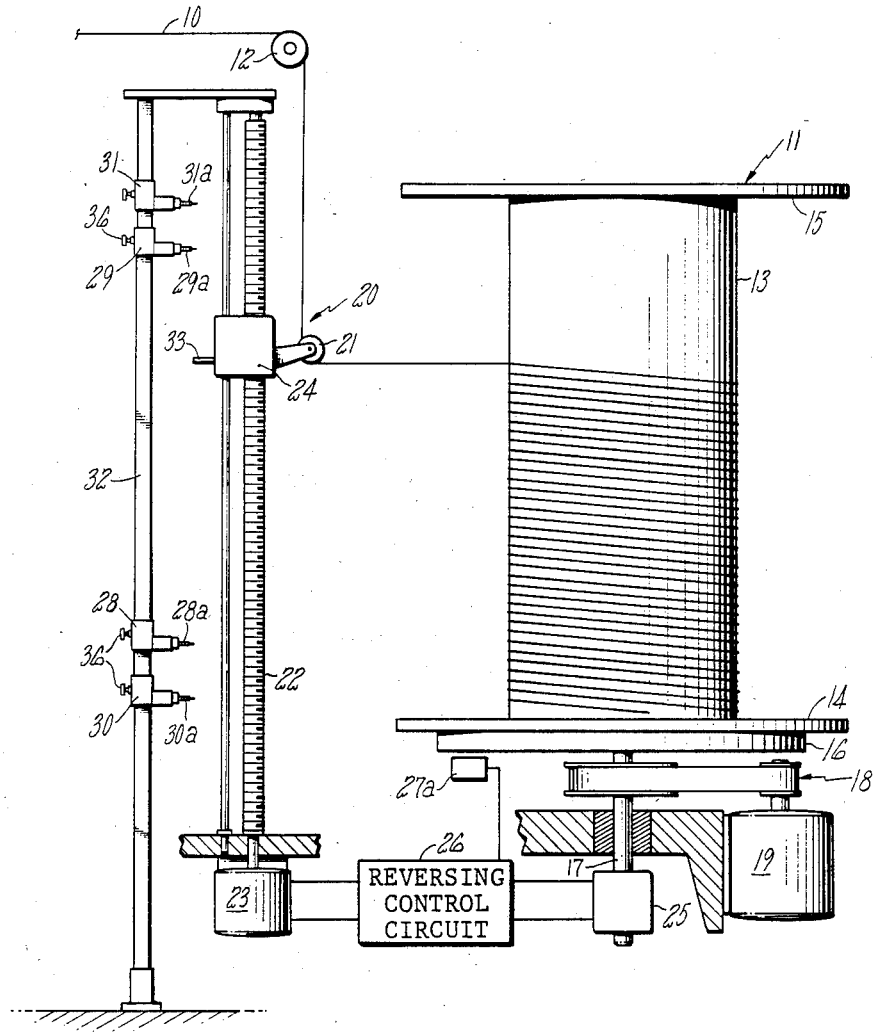
FIG. 1 is a diagrammatic representation of the mechanical parts and some of the control means of strand spooling apparatus according to the present invention.

Referring first to FIG. 1, there is shown somewhat diagrammatically a spooling apparatus for winding an advancing strand or wire 10 onto a conventional spool 11 as the wire 10 is delivered over a guide roller 12 from wire processing apparatus (not shown). The spool 11 has a generally cylindrical barrel 13 with a circular disc mounted at each end thereof and forming respective end flanges 14 and 15. The spooling apparatus comprises a base 16 upon which the lower end flange 14 of the spool 11 is supported for rotation of the spool about its central axis. A drive shaft 17 for the base 16 is connected by means of a pulley and belt transmission 18 to an electric motor 19 or other suitable motive means.

The spooling apparatus also comprises a traverse mechanism 20 having a wire guide sheave or traversing guide 21 arranged to travel back and forth along a path lengthwise of the spool 11 and to guide the wire 10 onto the spool 11 between its end flanges 14 and 15. The traverse mechanism 20 includes a screw shaft 22 journalled in spaced relation with the spool 11 and driven by a reversible motor 23 at a rotational speed related to the rotational speed of the spool 11. Depending upon whether the motor 23 is supplied with a forward or a reverse control signal it causes the screw shaft 22 to rotate either in a clockwise or counterclockwise direction. A carriage 24 which rotatably supports the guide sheave 21 carries a ball nut threadably engaging the screw shaft 22 for effecting reciprocation of the guide sheave 21 back and forth lengthwise of the spool 11.

Although the drive motor 23 could incorporate a reversing mechanism to which forward and reverse control signals are supplied, the motor 23 is preferably a two-phase alternating current motor which has its direction of rotation reversed by reversing the phase sequence of electric currents supplied to it. The power source for operation of the drive motor 23 is provided by a two-phase alternator 25 driven by the main drive shaft 17 and thereby supplying alternating current of a frequency related to the rotational speed of the spool 11. The output of the alternator 25 is connected to the motor 23 by a reversing control circuit 26 which includes means to be subsequently described for selectively supplying currents of either one phase sequence or an opposite phase sequence connection as respective forward and reverse control signals to actuate the motor 23. A pulse generator **27*a* mounted adjacent the rotating base 16 cooperates with spokes (not shown) or other means on the base 16 to produce a predetermined number of pulses in response to each revolution of the base 16. The pulses produced by the pulse generator 27*a* are supplied to a preset counter 27 (FIG. 4) which is associated with the reversing control circuit 26** in a manner also to be subsequently described.

In accordance with one aspect of the present invention, the limits of reciprocation of the guide sheave 21 between two adjustably selected reversal points are determined by two reference position detectors 28 and 29 which are electrically connected to the reversing control circuit 26. These detectors together with two additional over-travel reference position detectors 30 and 31 are slidably mounted on a standard 32 that is mounted laterally adjacent to and parallel to the path of travel of the guide sheave 21. The detectors 28. 29, 30 and 31 have respective resilient electrical contact members **28*a*, 29*a*, 30*a* and 31*a* positioned along the course of travel of an electrically grounded contact element 33 that is fixedly mounted to the carriage 24** and includes a rigid contact portion extending outwardly to provide a switch contact.

Each of the detectors 28, 29, 30 and 31 are of like construction and therefore a detailed description of the detector 28 will suffice. As best shown in FIGS. 2 and 3, the detector 28 includes a tubular casing or support member 34 of rectangular cross section dimensioned for free sliding movement upon the standard 32. A clamp screw 35 having a head or knob 36 at its outer extremity is threaded through a nut 37 which is secured to the exterior of one side of the casing 34. The clamp screw 35 passes through a hole in the casing 34 so that its inner extremity may be frictionally engaged with the standard 32 to lock the detector 28 at a selected location on the standard 32. Welded or brazed at one end to an opposite side of the casing 34 is a contact housing 38 in which is secured a bushing 39 of an electrical insulation material. The resilient contact member **28*a* includes a tightly coiled helical spring 40 of electrically conductive metal having one end extending into the bushing 39 and fixed thereto by suitable means such as an epoxy resin. A short conductive contact tab 41 is soldered to the outwardly extending end of the spring 40 to provide a displaceable switch contact. A conductor 42 passing through a suitable opening in a side wall of the of the contact housing 38 is soldered to the inner end of the spring 40 for connecting the contact element 28*a*** in circuitry to be subsequently described.

The contact tabs 41 of the detectors 28, 29, 30 and 31 are positioned along the course of travel of the contact element 33 for engagement thereby whenever the guide sheave 21 moves to respective selected positions along its path of travel. As the contact element 33 comes into engagement with one of the contact tabs 41, an electrical contact is established therebetween whereby the conductor 42 of the respective one of the contact members **28*a*, 29*a*, 30*a* and 31*a* is grounded. If, after the contact element 33 engages one of the contact tabs 41, there is a continued movement of the contact element 33, the respective spring 40 will yield to permit the contact tab 41 to be momentarily deflected out of the course of travel of the contact element 33. As soon as the contact element 33 then disengages from the contact tab 41, the spring 40 will return the contact tab 41 to its initial position. Each contact engagement between the contact element 33 and one of the contact tabs 41 thus provides a reference position signal which is used to control operation of the drive motor 23. It will be apparent that such a reference position signal in the nature of an electrical signal pulse will be produced by either of the detectors 28 and 29 during each traversing movement in either direction of the guide sheave 21** past the respective detector.

Figure 4:
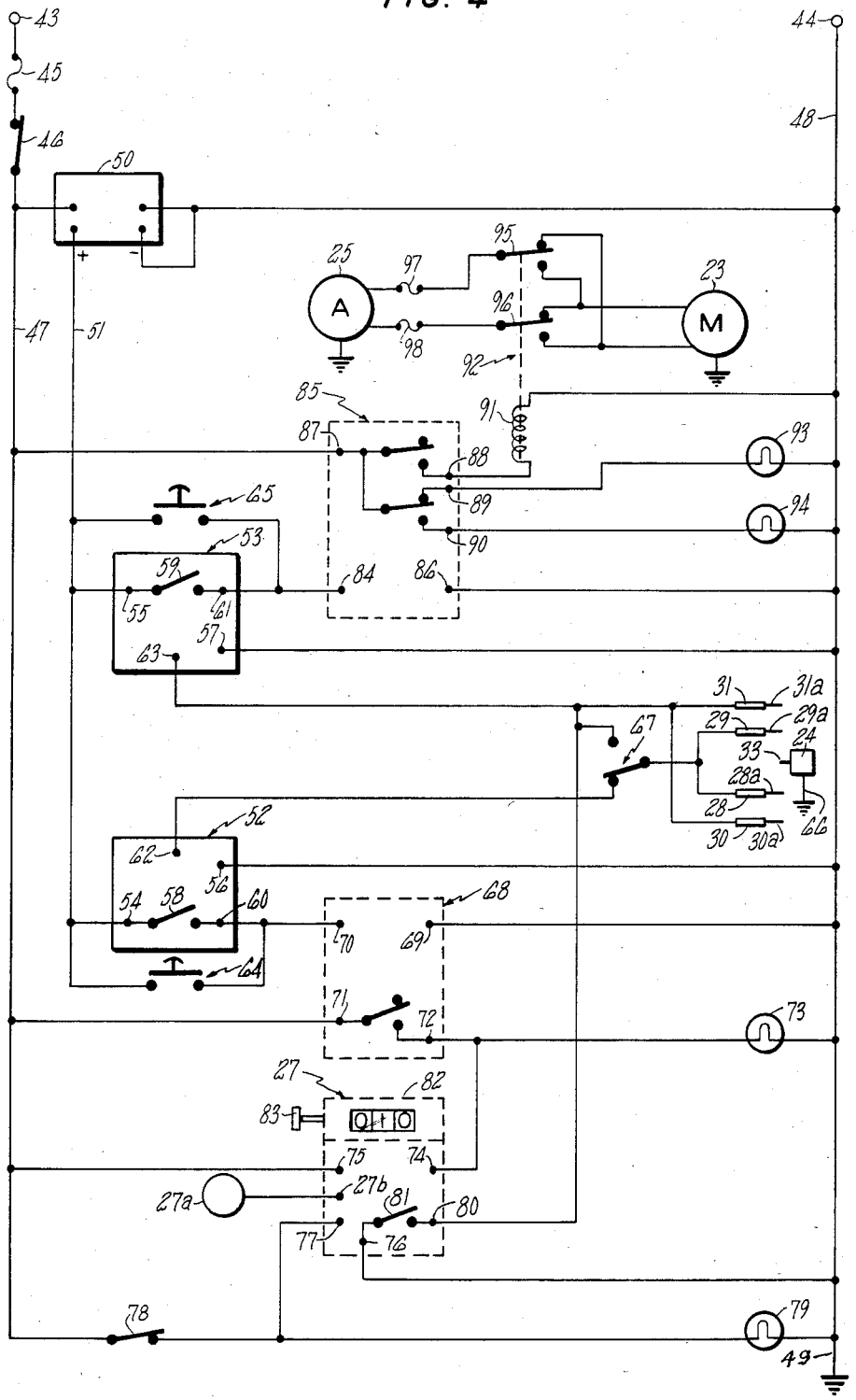
FIG. 4 is a schematic diagram of a control circuit for the apparatus illustrated in FIG. 1.

FIG. 4 illustrates a control circuit for providing forward and reverse control signals to the drive motor 29 of the traverse mechanism 20 shown in FIG. 1. Identical Parts are designated by the same reference numerals in both Figures.

The control circuit includes an ungrounded line terminal 43 and is ground neutral terminal 44 adapted to be connected to a suitable source of alternating current power, typically of 120 volts. The terminal 43 is connected by a fuse 45 and a switch 46 to a power conductor 47 while a ground conductor 48 extends from the terminal 44 and is suitably grounded as indicated at 49. A direct current power supply 50 having an input connected to the conductors 47 and 48 provides direct current power of a low voltage such as 12 volts at output terminals which are connected to the ground conductor 48 and a power conductor 51.

Two conventional impulse actuated on-off timer devices or time delay relays 52 and 53 have respective power terminals 54 and 55 connected to the conductor 51 and respective ground terminals 56 and 57 connected to the conductor 48. The time delay relays 52 and 53 contain respective normally open switches 58 and 59 which each may be momentarily closed for a short period of time to provide an output signal pulse of a predetermined duration at corresponding switch output terminals 60 and 61. The closing of each of the switches 58 and 59 is initiated by the application of a ground path input signal to the respective control input terminals 62 and 63 which are normally maintained at a low potential supplied from the conductor 51. For purposes to be explained later, a normally open manually operable reset switch 64 is connected in parallel with the switch 58 of time delay relay 52 and another normally open manually operable reset switch 65 is connected in parallel with the switch 59 of time delay relay 53.

The input signals supplied to the input terminal 62 of time delay relay 52 are provided by engagement of the contact element 33 with the respective contact members 28*a* and 29*a* of the reference positions detectors 28 and 29. The contact element 33 is connected to ground potential by grounding of the carriage 24 as indicated at 66. A manually operable switch 67 normally occupies the position shown in which it completes a series circuit from the power conductor 51 through the power terminal 54 and input terminal 62 of the time delay relay 52, either selected one of the contact members 28*a* and 29*a*, and the contact element 33 of carriage of carriage 24 to ground. In its alternate position, the switch 67 connects the contact members 28*a* and 29*a* to the input terminal 63 of time delay relay 53.

A bistable circuit or flip-flop 68 has input terminals 69 and 70 connected respectively to the ground conductor 48 and the switch output terminal 60 of the time delay relay 52. The flip-flop 68 has an output at terminals 71 and 72 alternately switchable between a switched-on state and a switched-off state. The flip-flop is of a conventional type which changes its output state each time a signal pulse is applied to its input terminals 69 and 70 in response to the closing of the time delay relay switch 58. One output terminal 71 is connected to the power conductor 47 and the other output terminal 72 is connected to one end of an indicator lamp 73, the other end of which is connected to the ground conductor 48.

Also connected to the output terminal 72 of the flip-flop 68 is the operation start and reset terminal 74 of the preset counter 27. This counter may be a conventional, commercially available revolution counting device such as the Model CXA5 manufactured by Eagle Signal Company. Electric power for operation of the counter 27 is supplied to a power terminal 75 and a ground terminal 76 respectively connected to the conductors 47 and 48. An actuating terminal 77 of the counter 27 is connected to the conductor 47 by a manually operable switch 78 which is normally closed to render the counter 27 operative. An indicator lamp 79 connected at one end to the ground conductor 48 is also energized through the switch 78. Connected between the ground terminal 76 and an output terminal 80 is the normally open counter switch 81.

The counter 27 includes a count value selector shown as a register 82 which may be manually set to store a selected count value by a knob 83. The counter 27 also has a pulse input terminal 27*b* connected to the pulse generator 27*a* for producing a count responsive to the number of revolutions of the spool 11. Counting operation of the counter 27 is initiated when the output of the flip-flop 68 switches to a switched-on state to connect the input terminal 74 of the counter to the power conductor 47. When the count of spool revolutions by the counter 27 attains the selected value preset or stored in the register 82, the counter switch 81 is actuated to its closed state, thus providing a ground path signal at the output terminal 80. The count of spool revolutions in the counter 27 is reset to zero or some other predetermined initial value and the counting operation is inhibited when the flip-flop 68 switches to its switched-off state. At the same time that the counter 27 is thus rest, the counter switch 81 is actuated to its open state.

The output terminal 80 of the counter 27 is connected to the control input terminal 63 of the time delay relay 53. The output terminal 61 of time delay relay 53 is, in turn, connected to one input terminal 84 of a bistable circuit or flip-flop 85 which has its other input terminal 86 connected to the ground conductor 48. The output circuit of the flip-flop 85 comprises a common output terminal 87 connected to the conductor 47 and three output terminals 88, 89, and 90 connected respectively to one end of the operating coil 91 of a contactor 92, one end of an indicator lamp 93, and one end of an indicator lamp 94, the other ends of which are all connected to the ground conductor 48. The flip-flop 85 is of a conventional type having two output operating conditions which alternate upon application of successive input signals to the input terminals 84 and 86. In the output operating condition shown, only the output terminal 89 is in a switched-on state with the output terminal 87. In the alternate output operating condition of flip-flop 85, the output terminals 88 and 90 are in a switched-on state with the output terminal 87 and the output terminal 89 is in a switched-off state.

The contactor 92 comprises a pair of double throw switches 95 and 96 having their movable contacts connected by fuses 97 to the output of the alternator 25. The stationary contacts of the switches 95 and 96 are connected to the reversible motor 23 of the traverse mechanism 20 in a current reversing arrangement with the switches 95 and 96 occupying the positions shown when the contactor coil 91 is not energized. Upon energization of the operating coil 91, the switches 95 and 96 are operable to alternate positions which effect a reversal in the phase sequence connection of the alternator 25 to the motor 23.

In use of the spooling apparatus shown in FIG. 1, the register 82 of the counter 27 is set to a desired selected value and the reference position detectors 28 and 29 are adjusted along the standard 32 to selected positions relative to the respective adjacent end flanges 14 and 15 of the spool 11. At these selected positions of the detectors 28 and 29, the contact members 28*a* and 29*a* are located at predetermined reference positions each a selected distance from a respective desired end limit or reversal point of the traversing movement of the wire guide 21. This selected distance from a reversal point is dependent upon the selected preset value stored in the register 82. The reference position detectors 30 and 31 are also adjusted along the standard 32 to locate the contact members 30*a* and 31*a* at positions slightly beyond the respective desired reversal points of the traversing movement if the wire guide 21.

In operation of the spooling apparatus as illustrated in FIG. 1, an empty spool 11 has been placed upon the base 16 and a lead end of the wire 10 has been passed over the guide roller 12 and the traversing guide 21 and then secured to the lower flange 14 of the spool 11. The traversing guide 21 which was initially at a position adjacent the end flange 14 when the motor 19 was started to rotate the spool 11 has been advanced upwardly to the position shown by the rotating screw shaft 22 as turns of wire 10 have been helically wound upon the spool barrel 13. At this time, the parts of the control circuit are in the states or positions shown in FIG. 4. The traverse drive motor 23 is supplied with power from the alternator 25 through the normally closed stationary contacts of contactor switches 95 and 96. The indicator lamp 93 is energized from conductor 47 through the output terminals 87 and 89 of flip-flop 85 to indicate that the carriage 24 of the traverse mechanism 20 is moving upwardly. The energization of the counter actuating terminal 77 from conductor 47 through the switch 78 is indicated by indicator lamp 79.

As the carriage 24 continues its upward movement, it carries the contact element 33 into engagement with the contact member 29*a* of reference positions detector 29 which is thereafter momentarily deflected out of the course of travel of the contact element 33 and then disengaged therefrom. When the contact element 33 initially engages the contact member 29*a*, a ground path circuit is completed from the control input terminal 62 of time delay relay 52 through the switch 67, contact member 29*a*, contact element 33 and the carriage 24 to ground. This causes the switch 58 of time delay relay 52 to momentarily close and thus provide a reference position signal pulse to the input terminals 69 and 70 of flip-flop 68. In response to this signal pulse, the flip-flop 68 is triggered to its switched-on state and connects the input terminal 74 of the counter 27 to the line 47 through its output terminals 71 and 72 to initiate counting operation of the counter 27. The indicator lamp 73 is also energized to indicate that the counter 27 has begun to produce a count responsive to the number of revolutions of the spool 11. When the counter 27 counts to the preset value stored in the register 82, the counter switch 81 is actuated to its closed state.

The closing of counter switch 81 completes a ground path circuit from the control input terminal 63 of time delay relay 53 through terminals 80 and 76 of the counter 27. This causes the switch 59 of time delay relay 53 to momentarily close and thus provide a signal pulse to the input terminals 84 and 86 of the flip-flop 85. In response to this signal pulse, the flip-flop 85 is triggered to its alternate output condition in which the output terminals 88 and 90 are in a switched-on state and the output terminal 89 is in a switched-off state. At this time, the operating coil 91 of the contactor 92 is energized from the output terminal 88 and actuates the movable contacts of switches 95 and 96 into engagement with the normally open stationary contacts to effect a reversal of the phase sequence connection of the alternator 25 to the traverse motor 23. The motor 23 will now reverse its direction of rotation and cause the carriage 24 to move downwardly. At the same time, the indicator lamp 93 is deenergized and the indicator lamp 94 is energized to indicate that the carriage 24 is moving downwardly.

As the carriage 24 returns from its upper reversal point and passes the reference position detector 29 in a downwardly direction, it again carries the contact element 33 into engagement with the contact member 29*a* which is thereafter momentarily deflected out of the course of travel of the contact element 33 and disengaged therefrom. When the contact element initially engages the contact member 29*a* this time, a ground path circuit is again completed to the control input terminal 62 of time delay relay 52. This causes the switch 58 of time delay relay 52 to again momentarily close and provide another signal pulse to the input terminals 69 and 70 of flip-flop 68. In response to this signal pulse, the flip-flop 68 reverts to its switched-off state thereby disconnecting the indicator lamp 73 and the input terminal 74 of counter 27 from the conductor 47. Upon this deenergization of input terminal 74, counting operation of the counter 27 is inhibited, the count of spool revolutions in the counter 27 is reset to its initial value, and the counter switch 81 is actuated to its open position.

Upon continued downward movement of the carriage 24, it passes the reference position detector 28 and carries the contact element 33 into engagement with the contact member 28*a* which is thereafter momentarily deflected out of the course of travel of the contact element 33 and then disengaged therefrom. When the contact element 33 initially engages the contact member 28*a* a ground path circuit is completed from the control input terminal 62 of time delay relay 52 through the switch 67, contact member 28*a*, contact element 33 and the carriage 24 to ground. This causes the switch 58 of time delay relay 52 to momentarily close and provide another reference position signal pulse to the input terminals 69 and 70 of flip-flop 68. In response to this signal pulse, the flip-flop 68 is again triggered to its switched-on state and connects the input terminal 74 of counter 27 to the conductor 47 to initiate counting operation of the counter 27. The indicator lamp 73 is also energized to indicate that the counter 27 is producing a count of spool revolutions. When the counter 27 counts to the preset value stored in the register 82, the counter switch 81 is actuated to its closed position.

The closing of counter switch 81 again completes a ground path circuit to the control input terminal 63 of time delay relay 53. This causes the switch 59 of time delay relay 53 to momentarily close and thus provide a signal pulse to the input terminals 84 and 86 of flip-flop 85. In response to this signal pulse, the flip-flop 85 reverts to its original output condition in which the output terminals 88 and 90 are in a switched-off state and the output terminal 89 is in a switched-on state. The operating coil 91 of the contactor 92 is accordingly deenergized allowing the movable contacts of the switches 95 and 96 to return into engagement with the normally closed stationary contacts and effect a reversal of the phase sequence connection of the alternator 25 to the traverse motor 23. This causes the motor 23 to reverse its direction of rotation so as to cause the carriage 24 to move upwardly. At the same time, the indicator lamp 94 is deenergized and the indicator lamp 93 is energized to indicate that the carriage 24 is moving upwardly.

As the carriage 24 returns from its lower reversal point and passes the reference position detector 28 in an upwardly direction, it again carries the contact element 33 into engagement with the contact member 28*a* which is thereafter momentarily deflected out of the course of travel of the contact element 33 and then disengaged therefrom. When the contact element 33 initially engages the contact member 28*a* this time, a ground path circuit is again completed to the control input terminal 62 of time delay relay 52. This causes the switch 58 of time delay relay 52 to again momentarily close and provide another signal pulse to the input terminals 69 and 70 of flip-flop 68. In response to this signal pulse, the flip-flop 68 reverts to its switched-off state thereby disconnecting the indicator lamp 73 and the input terminal 74 of counter 27 from the conductor 47. Upon this deenergization of input terminal 74, counting operation of the counter 27 is inhibited, the count of spool revolutions in the counter 27 is reset to its initial value, and the counter switch 81 is actuated to its open position.

The traversing guide 21 is thus traveling upwardly to its original position shown in FIG. 1 and the parts of the control circuit are in the original states or positions shown in FIG. 4. The cycle of operation described above will then be repeated as often as required until the winding of wire 10 onto the spool 11 is completed. Each time the wire guide 21 passes one of the reference position detectors 28 and 29 during either its approach to or consequent return from a respective reversal point, a reference position signal pulse is produced by the time delay relay 52 in response to the establishment of a ground path circuit by engagement of the contact element 33 with a corresponding one of the contact elements 28*a* and 29*a*. The reference position signal pulse produced during approach of the wire guide 21 to a reversal point causes the flip-flop 68 to switch to a switched-on state to enable counting operation by the counter 27. The subsequent reference position signal pulse produced during consequent return of the wire guide 21 from the reversal point causes the flip-flop 68 to revert to its switched-off state to reset the counter 27 for a subsequent counting operation.

Each time the counter 27 is enabled for counting operation, it causes the counter switch 81 to close when the count of spool revolutions attains the preset value stored in the counter register 82. In response to each closure of the counter switch 81, the time delay relay 53 provides a signal pulse changing the output operating condition of the flip-flop 85 to cause the contactor 92 to reverse the polarity connection of the motor 23 to the alternator 25. Thus when a reference position signal pulse is produced as the wire guide 21 passes one of the reference position detectors 28 and 29 in approaching a reversal point, the movement of the wire guide 21 continues in the same direction until the number of spool revolutions following production of the reference position signal pulse reaches a predetermined value corresponding to the preset value stored in the counter register 82. During these predetermined number of spool revolutions, the distance of movement of the wire guide 21 will also be of a predetermined length since the rotational speed of the traverse motor 23 is directly related to the rotational speed of the spool 11. Accordingly, it is seen that the reversal points of the traverse mechanism 20 are determined by the selected preset value stored in the counter register 82 and the selected positions of the reference position detectors 28 and 29.

The contact members 30*a* and 31*a* of reference position detectors 30 and 31 are positioned to be engaged by the contact element 33 only if the wire guide 21 should for some unexpected reason travel past its desired respective lower or upper reversal point. In such an event, the engagement of the contact element with a respective one of the contact members 30*a* and 31*a* would complete a ground path circuit to the input terminal 63 of flip-flop 53 and accordingly effect a reversal in the direction of travel of the wire guide 21. It will also be apparent that the switch 67 may be temporarily actuated to its alternate position to effect a reversal in the direction of travel of the wire guide 21 each time the contact element 33 initially moves into engagement with one of the contact members 28*a* and 29*a*. This type of operation may be desired under certain emergency conditions such as when the spooling apparatus is being adjusted for us with a different size or type of spool.

Depending upon the states or positions last occupied by the parts of the control circuit shown in FIG. 4, it may be necessary to reset the output state or condition of flip-flop 68 or 85 before commencing a spooling operation. For this purpose, switch 64 may be momentarily closed to trigger flip-flop 68 to its opposite output state and switch 65 may be momentarily closed to trigger flip-flop 85 to its opposite output condition. The appropriate resetting action required will be evident from viewing of the indicator lamps 73, 93 and 94.

From the foregoing description, it will be seen that the present invention affords simple and reliable means for controlling the traversing wire guide movement in spooling apparatus. The reference position detectors 28 and 29 cooperate with the contact element 33 on the carriage 34 to produce reference position signals at precisely selected points along the path of travel of the wire guide 21. These detectors 28 and 29 are easily and quickly adjusted to selected positions on the standard 32 as required for different types and sizes of spools in considerably less time than that required for prior mechanical switching systems utilizing cam-operation switches. The control system reliably responds to the establishment of ground path circuits by the reference position detectors 28 and 29 and further provides for indicator lamps to conspicuously reveal the operating conditions of the control system to the operator of the spooling apparatus. The control system, however, is simple to permit a compact construction.

What is claimed is:

1. In an apparatus for winding strand onto a spool having end flanges. which apparatus comprises means for rotating a flanged spool about its central axis, a traversing guide arranged to travel back and forth along a path lengthwise of said spool and to guide strand onto said spool between the end flanges thereof, drive means arranged to move said traversing guide in forward and reverse directions lengthwise of said spool in response respectively to forward and reverse control signals supplied thereto, and control means coupled to said drive means for providing said drive means with alternate forward and reverse control signals to actuate said drive means to reverse the direction of travel of said traversing guide when it reaches either of two adjustably selected reversal points; the improvement wherein said control means comprise:

reference position detector means adjustably positioned along the path of travel of said traversing guide and operative to provide a reference position signal in response to each traversing movement in either direction of said traversing guide through either of two reference positions each located at a selected distance from a respective one of said reversal points whereby a first and then a second of said reference position signals are respectively produced each time said traversing guide passes either of said reference positions in opposite directions during its approach to and consequent return from a respective reversal point;

first bistable means having an output switchable between a switched-on and a switched-off state; said first bistable means being responsive to successive ones of said first and second reference position signals to switch its output from a switched-off state to a switched-on state whenever a first reference position signal is produced by said reference position detector and to switch its output from a switched-on state to a switched-off state whenever a consequent second reference position signal is produced by said reference position detector means;

spool revolution counting means comprising a preset counter coupled to said spool rotating means and having an input connected to the output of said first bistable means; said counter being responsive to switching of the output of said first bistable means to said switched-on state to initiate counting operation and to produce a count responsive to the number of revolutions of the spool until the count attains a selected preset value; said counter being reset from said preset value to a predetermined lower initial value and its counting operation being inhibited in response to switching of the output of said first bistable means to said switched-off state; said counter including switch means having first and second operating states and being operative to switch from said first operating state to said second operating state when said counter counts to said preset value and to return to said first operating state when said counter is reset to said lower initial value;

second bistable means having an input connected to said counter switch means; said second bistable means having an output with first and second operating conditions which alternate upon successive switching of said counter switch means from said first operating state to said second operating state; and means responsive to the output of said second bistable means for producing said forward and reverse control signals in response to switching of the output of said second bistable means to respective first and second operating conditions.

2. In an apparatus for winding strand onto a spool having end flanges, which apparatus comprises means for rotating a flanged spool about its central axis, a traversing guide arranged to travel back and forth along a path lengthwise of said spool and to guide strand onto said spool between the end flanges thereof, drive means arranged to move said traversing guide in forward and reverse directions lengthwise of said spool in response respectively to forward and reverse control signals supplied thereto, and control means coupled to said drive means for providing said drive means with alternate forward and reverse control signals to actuate said drive means to reverse the direction of travel of said traversing guide when it reaches either of two adjustably selected reversal points; the improvement wherein said control means comprise:

reference position detector means adjustably positioned along the path of travel of said traversing guide and operative to provide a reference position signal pulse in response to each traversing movement in either direction of said traversing guide through either of two reference positions each adjacent to a respective one of said spool end flanges whereby a first and then a second of said reference position signal pulses are produced each time said traversing guide passes one or the other of said reference positions in opposite directions during its approach to and consequent return from a respective reversal point;

first bistable means having an input connected to said reference position detector means and having an output switchable between a switched-on and a switched-off state; said first bistable means responding to successive ones of said first and second reference position signal pulses to switch its output from a switched-off state to a switched-on state whenever a first reference position signal pulse is produced by said reference position detector means and to switch its output from a switched-on state to a switched-off state whenever a second reference position signal pulse is produced by said reference position detector means;

spool revolution counting means comprising a preset counter coupled to said spool rotating means and including an input connected to the output of said first bistable means and switch means having first and second operating states; said counter being responsive to switching of the output of said first bistable means to said switched-on state to initiate counting operation and to produce count responsive to the number of revolutions of the spool until the count attains a selected preset value; said counter being reset from said preset value to a predetermined lower initial value and its counting operation being inhibited in response to switching of the output of said first bistable means to said switched-off state; said switch means being operative to switch from said first state to said second state when said counter counts to said preset value and to return to said first state when said counter is reset to said lower initial value;

second bistable means having an input connected to said counter switch means; said second bistable means having an output with first and second operating conditions which alternate upon successive switching of said counter switch means from said first state to said second state; and means connected to said drive means and responsive to the output of said second bistable means for producing said forward and reverse control signals in response to switching of the output of said second bistable means to respective first and second operating conditions.

3. In an apparatus for winding strand onto a spool having end flanges, which apparatus comprises means for rotating a flanged spool about its central axis, a traversing guide arranged to travel back and forth along a path lengthwise of said spool and to guide strand onto said spool between the end flanges thereof, drive means arranged to move said traversing guide in forward and reverse directions lengthwise of said spool in response respectively to forward and reverse control signals supplied thereto, and control means coupled to said drive means for providing said drive means with alternate forward and reverse control signals to actuate said drive means to reverse the direction of travel of said traversing guide when it reaches either of two adjustably selected reversal points: the improvement wherein said control means comprise:

reversal point adjustment means for adjustably determining the reversal points of the traversing movement of said traversing guide; said reversal point adjustment means comprising first and second reference position detectors adjustably positioned along the path of travel of said traversing guide at respective selected first and second reference positions which are adjacent respectively to one and the other of said spool end flanges; said first and second reference position detectors being responsive to each traversing movement in either direction of said traversing guide through said first and second reference positions, respectively, to provide an electrical signal pulse whereby one and then another of said signal pulses are produced each time said traversing guide passes one or the other of said reference positions in opposite directions during its approach and consequent return from a respective reversal point;

first bistable means having an input connected to both of said first and second reference position detectors and having an output switchable between a switched-on state and a switched-off state; said first bistable means switching its output from one of said states to the other each time a signal pulse is produced by either one of said reference position detectors; said first bistable means being operative to switch its output from a switched-off state to a switched-on state whenever a signal pulse is produced by one or the other of said reference position detectors upon movement of said traversing guide past a corresponding one or other of said reference positions during its approach to a respective reversal point and conversely to switch its output from a switched-on state to a switched-off state when a next successive signal pulse is produced by the same one or other of said reference position detectors upon consequent return of said traversing guide from said respective reversal point;

spool revolution counting means comprising a preset counter coupled to said spool rotating means and including operation start and reset means having an input connected to the output of said first bistable means, a count value selector settable to store a selected preset value, and switch means having first and second operating states; said operation start and reset means being responsive to switching of the output of said first bistable means to said switched-on state to initiate counting operation of said counter and to enable said counter to produce a count responsive to the number of revolutions of the spool until the count attains the preset value stored in said selector; said operation start and reset means further being responsive to switching of the ouput of said first bistable means to said switched-off state to reset said counter from said preset value to a predetermined lower initial value and to inhibit counting operation of said counter; said switch means being operative to switch from said first state to said second state when said counter counts to said preset value and to return to said first state when said counter is reset to said lower initial value;

second bistable means having an input connected to said counter switch means; said second bistable means having an output with first and second operating conditions which alternate upon successive switching of said counter switch means from said first state to said second state; and means connected to said drive means and responsive to the output of said second bistable means for producing said forward and reverse control signals in response to switching of the output of said second bistable means to respective first and second operating conditions.

4. The invention according to claim 3 wherein said reversal point adjustment means include an electrical contact element movable with said traversing guide back and forth along a predetermined course; and wherein said first and second reference position detectors comprise respective first and second resilient electrical contact members positioned along said course for engagement by said contact element upon movement of said traversing guide back and forth through said first and second reference positions; each of said contact members being momentarily deflected out of said course in response to engagement thereof by said contact element whereby said contact element momentarily electrically contacts one or the other of said contact members upon engagement therewith to initiate the production of one of said electrical signal pulses.

5. The invention according to claim 4 including impulse actuated on-off timer means responsive to each engagement of one or the other of said contact members by said contact element to produce one of said electrical signal pulses having predetermined duration; said timer means having normally open switching means and input means operative upon each application of an input signal thereto to close said switching means for a time period of said predetermined duration; said switching means being connected to the input of said first bistable means to provide thereto one of said electric signal pulses in response to each closing of said switching means; said input means of said timer means being connected in a circuit energized from a low voltage source and connecting each of said contact members with said contact element, said input mesns and said low voltage source in series circuitry adapted to provide an input signal to said input means of said timer means to initiate closing of said switching means when either of said contact member is contacted by said contact element.

6. The invention according to claim 4 wherein said contact element is fixedly mounted to said traversing guide and includes a rigid contact portion extending from said traversing guide and providing a switch contact; and wherein each of said first and second contact members comprises a support member, an elongated tubular helical spring having one end fixed to said support member, and a contact tab fixed to the other end of said helical spring and providing a displaceable switch contact to be contacted by said rigid contact portion of said contact element.

7. The invention according to claim 6 including a standard mounted laterally adjacent and parallel to the path of travel of said traversing guide; said support members of said first and second contact members being adjustably mounted to said standard for selectively changing the respective positions of said first and second members along said course of movement of said contact element.

* * * * *